United States Patent [19]

Onoue

[11] Patent Number: 5,051,102

[45] Date of Patent: Sep. 24, 1991

[54] ASTERN-AHEAD SWITCHING DEVICE FOR MARINE PROPULSION UNIT

[75] Inventor: Akihiro Onoue, Hamamatsu, Japan

[73] Assignee: Sanshin Kogyo Kabushiki Kaisha, Hamamatsu, Japan

[21] Appl. No.: 575,284

[22] Filed: Aug. 30, 1990

[30] Foreign Application Priority Data

Aug. 30, 1989 [JP] Japan ..... 1-221633

[51] Int. Cl.[5] ..... B63H 21/28

[52] U.S. Cl. ..... 440/75; 440/86; 74/378

[58] Field of Search ..... 440/75, 84, 86, 900; 74/378, 480 B; 192/21, 48.1

[56] References Cited

U.S. PATENT DOCUMENTS

| | | | |
|---|---|---|---|
| 4,637,802 | 1/1987 | Taguchi et al. | 440/75 |
| 4,689,027 | 8/1987 | Harada et al. | 440/75 |
| 4,861,295 | 8/1989 | McElroy et al. | 440/75 |

*Primary Examiner*—Jesús D. Sotelo

*Attorney, Agent, or Firm*—Ernest A. Beutler

[57] ABSTRACT

A shift mechanism for a marine propulsion unit that is operative to permit shifting of the transmission into opposite directions in response to a given direction of shift input through reversal of the components. The components are constructed so that they may be reversed to achieve the reversal and operation without necessitating the use of different components.

8 Claims, 6 Drawing Sheets

ASTERN-AHEAD SWITCHING DEVICE FOR MARINE PROPULSION UNIT

BACKGROUND OF THE INVENTION

This invention relates to an astern-ahead switching device for a marine propulsion unit and more particularly to an improved shifting control for such a unit.

In marine propulsion transmissions, it is a normal practice to employ a bevel gear transmission comprised of a driving bevel gear and a pair of counterrotating driven bevel gears for selectively driving a propeller shaft in forward or reverse directions. Some form of shift mechanism is employed for moving a dog clutching element, which is positioned between the driven bevel gears, into selected engagement with either of the bevel gears for either forward or reverse drive.

In many applications, it is desirable to employ a pair of outboard drives for propelling a watercraft. However, in the use of such dual outboard drives, it is the normal practice to have the propeller shafts of the individual units rotate in opposite directions so as to reduce transverse thrust acting on the watercraft. This has previously been accomplished by providing units in which the engines drive in opposite directions. As a result, the right and left hand units of the prior art constructions have been substantially different and not fully interchangeable.

In U.S. Pat. No. 4,637,802, entitled "Twin Outboard Drive For Watercraft", issued Jan. 20, 1987, in the name of Michihiro Taguchi et al, and assigned to the assignee thereof, there is disclosed an arrangement wherein such a twin outboard drive can be employed without requiring oppositely rotating powering engines. In accordance with the construction shown in that patent, the shift mechanism is arranged so that when the shift levers controlling the two units are both moved in the forward direction, the bevel gear of one unit is moved in an opposite sense to the other unit. As a result, the reverse drive is possible without necessitating reversal of the direction of engine rotation.

In the embodiments shown in that application this reversal can be achieved by repositioning of certain components of the shift actuating mechanism. Although this provides simplicity and operation, certain elements of the shift actuating mechanism must be particularly designed for either the right or left hand side unit and are not interchangeable. This can give rise to a number of problems.

It is, therefore, a principal object of this invention to provide an improved shift actuating mechanism which permits selective reversal of the movement of the shifting member through repositioning of certain shift components without requiring different components to be substituted in order to reverse the direction of movement.

It is a further object of this invention to provide an improved shift actuating mechanism wherein the direction of shifting movement can be easily reversed merely by repositioning certain components.

It is a further object of this invention to provide an improved shift actuating mechanism wherein reversal can be achieved through the use of the same components but oriented in a different relationship.

SUMMARY OF THE INVENTION

This invention is adapted to be embodied in a shift mechanism for a marine propulsion transmission comprising a housing that defines a recess adapted to receive a shift plunger and supporting the shift plunger for reciproation. The shift plunger is formed with a cam surface that is adapted to receive a cam. A cam is supported for rotation relative to the housing and is received in the cam recess of the shift plunger for reciprocating the shift plunger upon rotation of the cam. The cam has an eccentric portion that is offset to one side of its rotational axis and which is selectively reversible between a first operative position wherein the eccentric portion lies on one side of a plane containing the rotational axis and a second operative position on the other side of the plane. The shift cam surface also includes an eccentric portion for receiving the cam eccentric portion. The shift plunger is symmetrical about a plane that extends perpendicular to the plane for selection inversion of the plunger in the recess between first and second operative positions upon selective rotation of the cam about its axis between its first and second operative positions so as to achieve reversal in the direction of reciprocation of the shift plunger in response to rotation of the shift cam in the same direction.

DETAILED DESCRIPTION OF THE PREFERRED EMBODIMENTS

Figure 1:
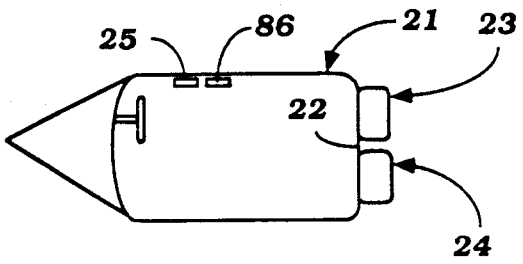
FIG. 1 is a schematic top plan view of a watercraft powered by a twin outboard drive constructed in accordance with an embodiment of the invention.

Referring first to FIG. 1, a watercraft adapted to be powered by a twin outboard drive constructed in accordance with an embodiment of the invention is identified generally by the reference numeral 21. The watercraft 21 includes a transom 22 to which first and second outboard drives 23 and 24 are supported for steering movement about respective generally vertically extending axes and for tilting and trim movement about horizontally extending axes. The outboard drives 23 and 24 may comprise either outboard motors, as in the illustrated embodiments, or the outboard drive portion of an inboard/outboard driving arrangement.

Each outboard drive 23 and 24 includes a forward, neutral and reverse transmission (to be described). Each transmission is selectively controlled by a respective controller 25 and 26 which is adapted to shift the transmissions associated with the outboard drives 23 and 24 between their forward, neutral and reverse positions, in a manner which will now be described by particular reference to the remaining figures of this embodiment.

Figure 2:
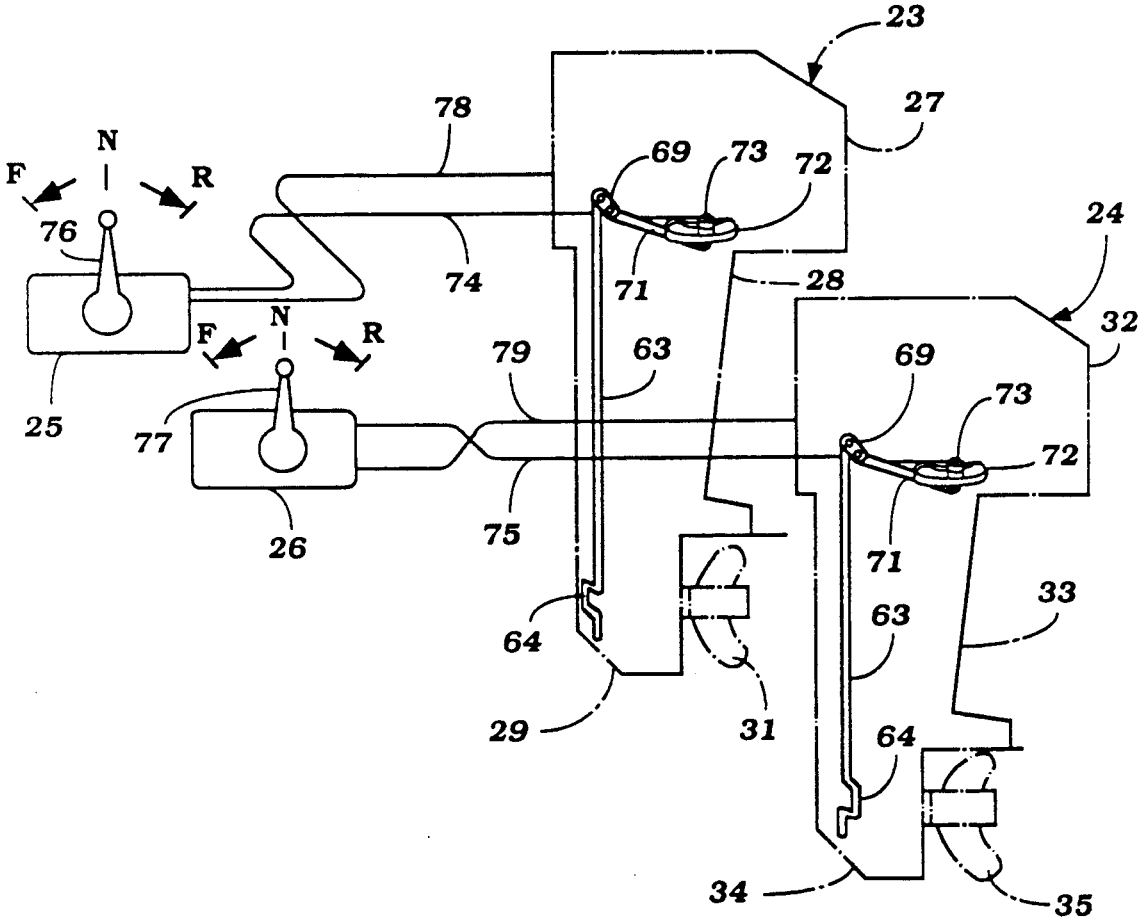
FIG. 2 is a partially schematic side elevational view of the outboard drive arrangement and the shifting mechanism associated therewith.

Referring first additionally to FIG. 2, the outboard motor 23 is comprised of a power head 27 that contains a powering internal combustion engine and a surrounding protective cowling. The engine within the power head 27 drives a drive shaft (to be described) that is journaled for rotation about a vertically extending axis and which passes through a drive shaft housing 28. A lower unit 29 is supported at the lower end of the drive shaft housing 28 and contains a forward, neutral, reverse transmission (to be described) for selectively driving a propeller 31 in either of forward or reverse directions. In addition, the transmission provides a neutral condition in which the propeller 31 is not driven.

In a similar manner, the outboard motor 24 includes a power head 32, drive shaft housing 33, lower unit 34 and propeller 35 which are generally of the same construction as the outboard motor 23. Unless differences between the outboard motors 23 and 24 are described, it is to be assumed that they are identical in construction.

The transmission associated with the outboard motor 23 will be described by particular reference to FIG. 3. As has been noted, the outboard motor 23 includes a drive shaft which is driven by its engine and which is identified by the reference numeral 36. Affixed to the lower end of the drive shaft 36 is a bevel driving gear 37 which rotates with the drive shaft 36. The drive gear 37 is in mesh with a pair of driven gears 38 and 39 that are disposed on diametrically opposite sides of the drive gear 37 so that rotation of the drive gear 37 will effect rotation of the driven gears 38 and 39 in opposite senses. Each of the driven gears 38 and 39 is rotatably journaled on a propeller shaft 41 in a manner to be described.

The propeller shaft 41 is, in turn, journaled within a bearing carrier 42 that is fixed within the lower unit 29 by means including a retainer 43. The propeller shaft 41 is journaled in part by means of an anti-friction bearing 44 which is of the needle type and which is carried at the rear end of the bearing carrier 42. The propeller 31 is affixed for rotation with the propeller shaft 41 in a known manner by means including a shock absorbing coupling 45 of any known type.

The driven gear 39 is rotatably journaled by means of a ball bearing 46 that is carried at the forward end of the bearing carrier 42. The propeller shaft 41 passes through and is journaled by the driven gear 39. Since the driven gear 39 in connection with the outboard motor 23 is in reverse gear, a plain bearing arrangement is provided between the gear 39 and the propeller shaft 41.

The driven gear 38, which comprises the forward drive gear, is rotatably journaled in the lower unit 29 by means of a tapered roller type thrust bearing 47. In turn, the driven gear 38 rotatably journals the forward end of the propeller shaft 41 by means of a pair of needed bearings (not shown).

Either of the driven gears 38 and 39 is selectively coupled for rotation with the propeller shaft 41 by means of a dog clutch which includes a clutching sleeve 49 that is axially movable along a splined connection with the outer periphery of the propeller shaft 41. The dog clutching sleeve 9 has oppositely facing dog clutching teeth that are adapted to selectively cooperate dwith respective dog clutching teeth formed on the driven gears 38 and 39, respectively.

A pin 55 extends diametrically through the dog cluching sleeve 49. The pin 55 extends through an elongated slot formed in the propeller shaft 41 so as to accommodate its axial movement relative to the propeller shaft 41 but so as to insure that the pin 55 and sleeve 49 rotate simultaneously with the propeller shaft 41. Of course, the rotational forces between the sleeve 49 and the propeller shaft 41 are transmitted through the splined connection between these elements.

Figure 4:
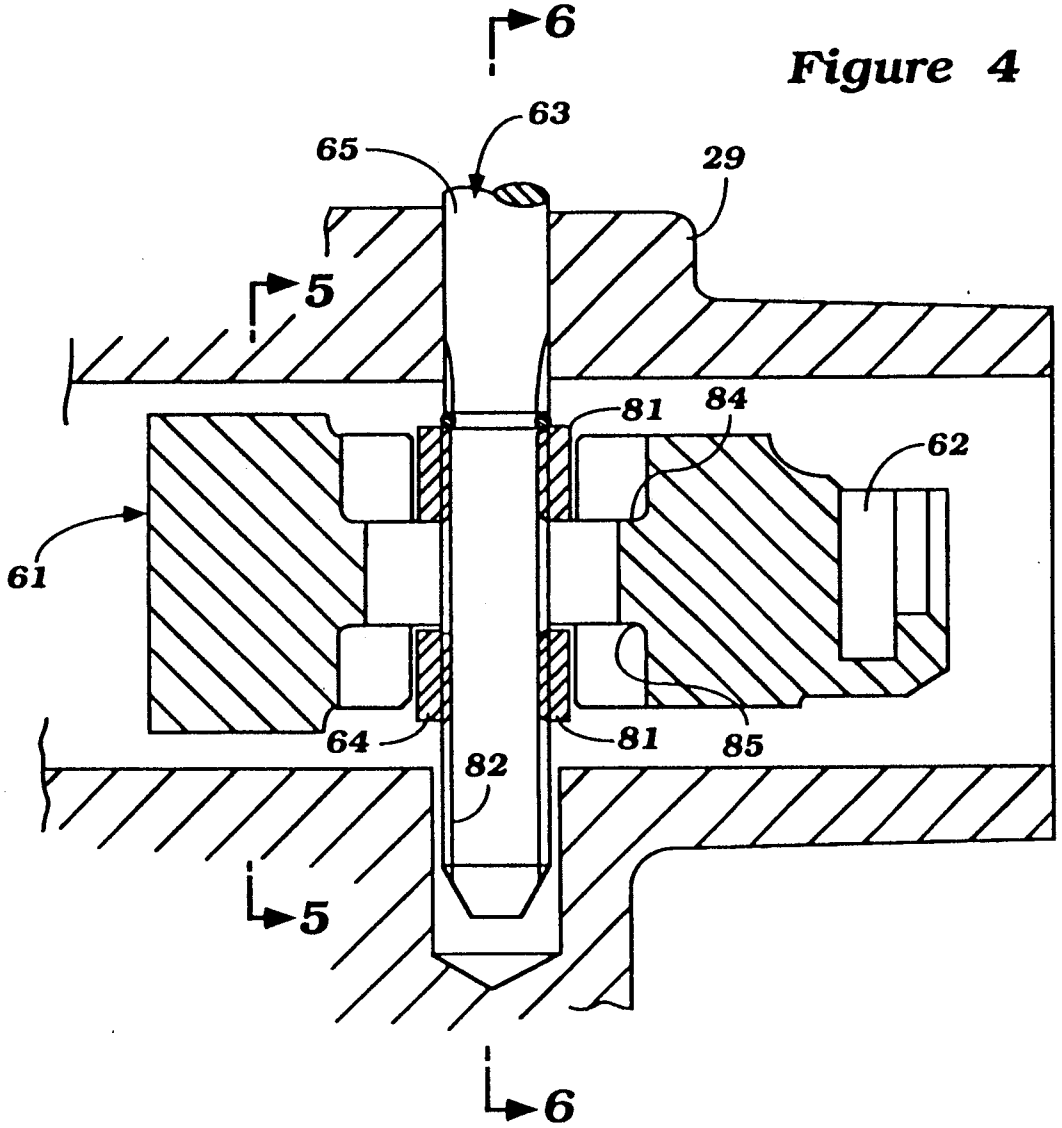
FIG. 4 is a further enlarged cross-sectional view showing the shift actuating mechanism.
Figure 5:
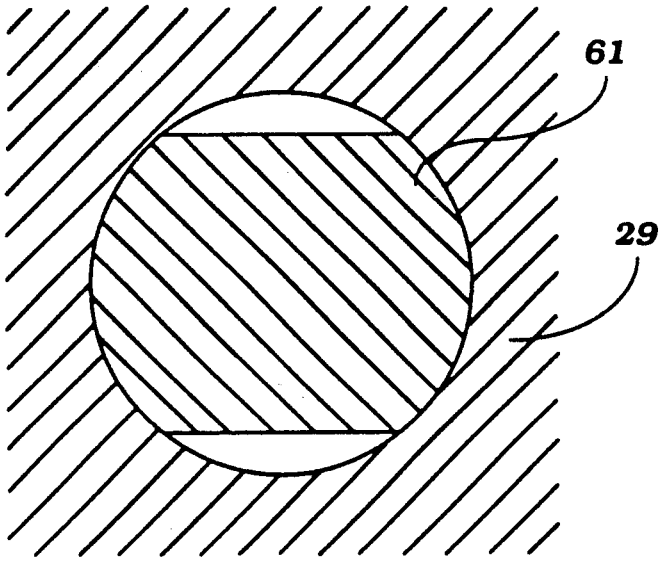
FIG. 5 is a cross-sectional view taken along the line 5—5 of FIG. 4.
Figure 6:
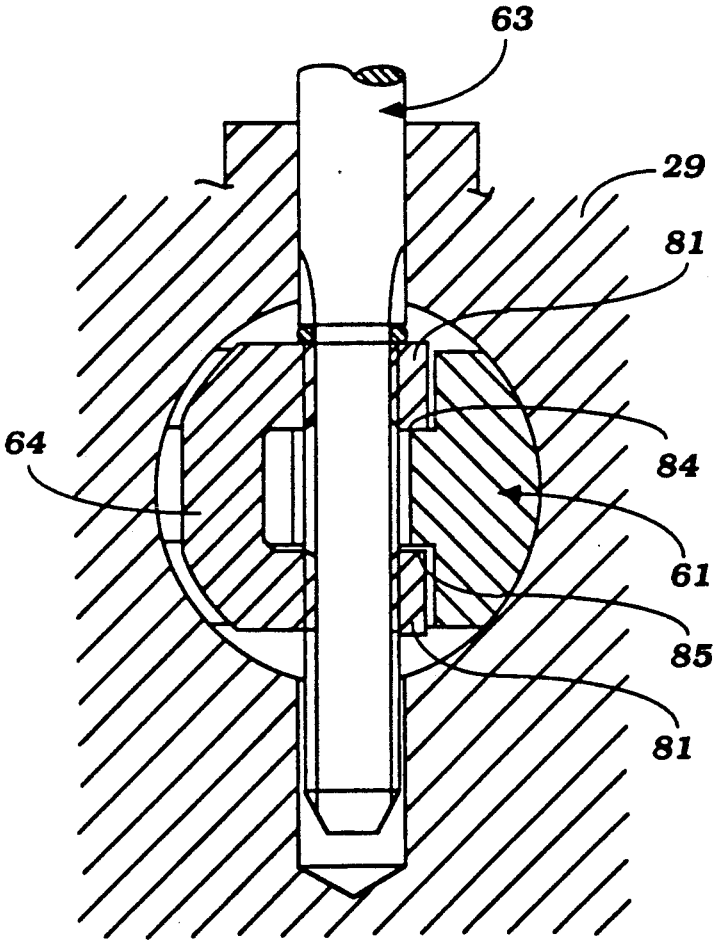
FIG. 6 is a cross-sectional view taken along the line 6—6 of FIG. 4.

The pin 55 and, accordingly, the clutching sleeve 49 is moved axially by means of a shifting sleeve 58 that is slidably supported within a bore formed at the forward end 59 of the propeller shaft 41. The pin 55 is staked to the sleeve 58 by passing through a pair of aligned cylindrical bores in the sleeve 58. The shifting sleeve 58 is affixed for axial movement with a shifting plunger 61 that is supported for reciprocation within the lower unit 29 by means of a tongue and groove connection 62 (FIG. 4). The tongue and groove connection 62 permits rotation of the sleeve 58 relative to the plunger 61 but couples the plunger 61 and sleeve 58 together for simultaneous reciprocation.

A shift rod 63 is journaled within the lower unit 29 and has a crank shaped cam portion 64 that is received within the plunger 61 in a manner to be described so as to effect reciproation of the plunger 61 and shift sleeve 58 upon rotation of the shift rod 63 so as to achieve shifting of the transmission. The transmission shifting mechanism also may include a detent for retaining the transmission in its neutral position.

Figure 3:
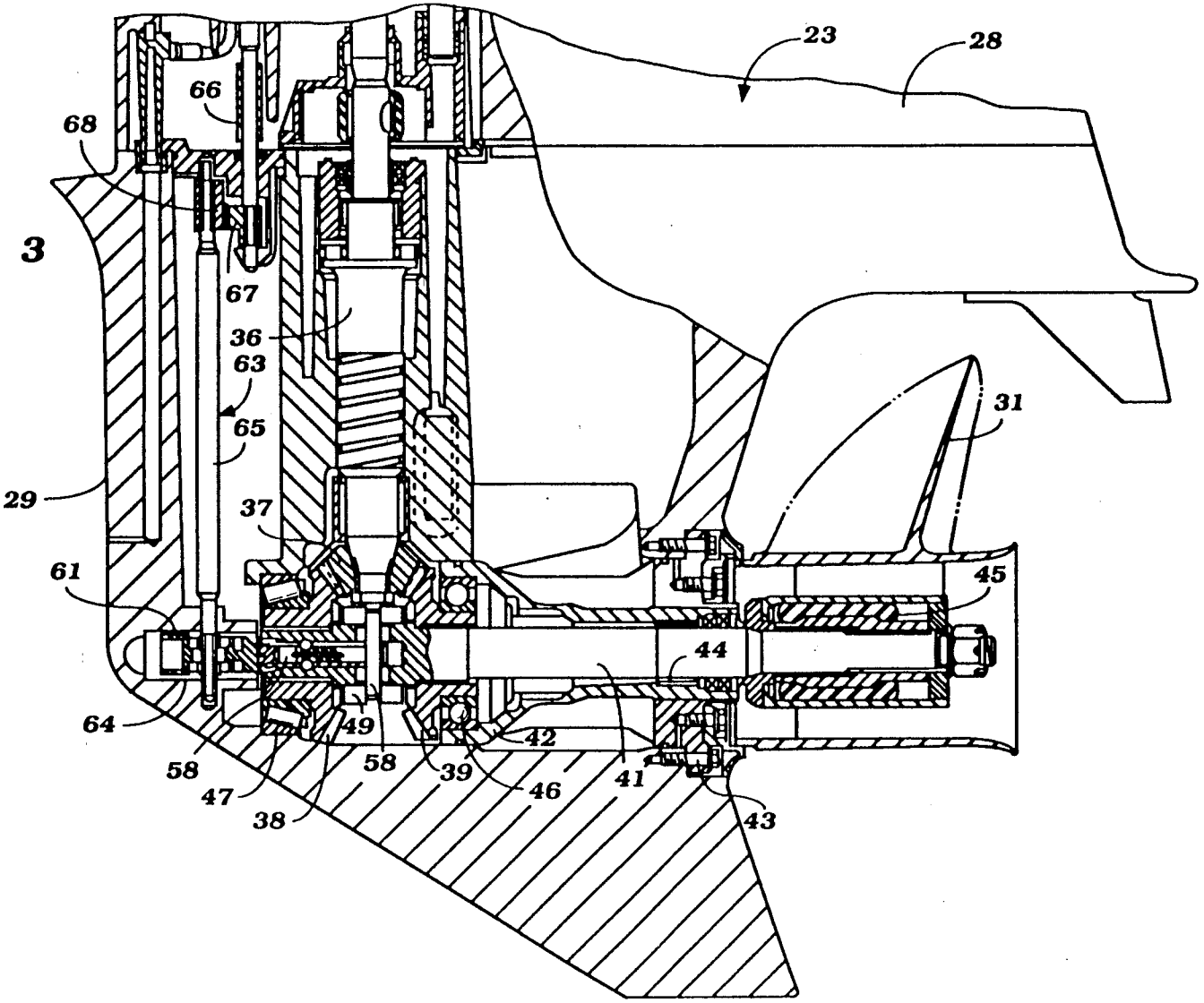
FIG. 3 is an enlarged side elevational view of the power unit of one of the marine outboard drives, with portions shown in section to illustrate the transmission and the shift mechanism associated therewith.

As may be seen in FIG. 3, the shift rod 63 is comprised of a lower portion 65 and an upper portion 66. A cam and follower mechanism 67 and 68 is interposed between the upper portion 66 and the lower portion 65 for transmitting motion between them. For simplicity, the two piece construction has not been shown in FIG. 2.

Referring now to FIG. 2, it will be noted that a link 69 is affixed to the upper end of the shift rod assembly 63 and is connected to a shifting lever 71. The shift lever 71 is formed with a cam groove 72 that receives a respective shift actuator 73. The shift actuator 73 of each of the outboard motors 23 and 24 is actuated by a respective wire actuator 74 or 75 of the respective control 25 and 26. The controls 25 and 26 are single lever controls that each includes a control lever 76 and 77 which couples not only the transmission shift control wires 74 and 75 but also throttle control wires 78 and 79 as is well known in this art.

The construction as thus far described may be considered to be substantially the same as that shown in aforenoted U.S. Pat. No. 4,637,802. For that reason, any portion of the construction which has not been described may be understood by reference to that patent. However, in accordance with the invention of this application, the cooperation of the shift rod 63 with the plunger 61 is done in such a way that the transmission associated with the outboard motor 23 will be shifted in a forward direction so as to achieve forward drive while the transmission associated with the outboard motor 24 will be shifted in the opposite direction so as to achieve forward drive but in a different direction of rotation of the propeller 35 and the propeller 31. That is, the shift levers 76 and 77 are both pushed forward to achieve forward drive of the outboard motors 23 and 24. However, in this forward drive condition, the propellers 31 and 35 will rotate in opposite senses. In a like manner, by shifting the levers 76 and 77 rearwardly, the transmission associated with the outboard motor 23 will be shifted rearwardly into its reverse drive condition while the transmission associated with the outboard motor 24 will be shifted forwardly into its reverse drive position. Thus, the outboard motors 23 and 24 will rotate in opposite directions without requiring reversal of the direction of rotation of either the powering internal combustion engine or the drive shaft 36.

Figure 7:
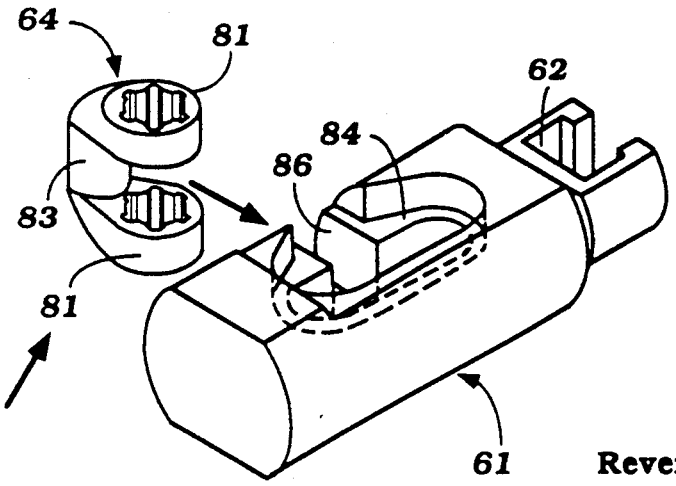
FIG. 7 is an exploded perspective view showing the shift actuating mechanism in one of its operative conditions.
Figure 8:
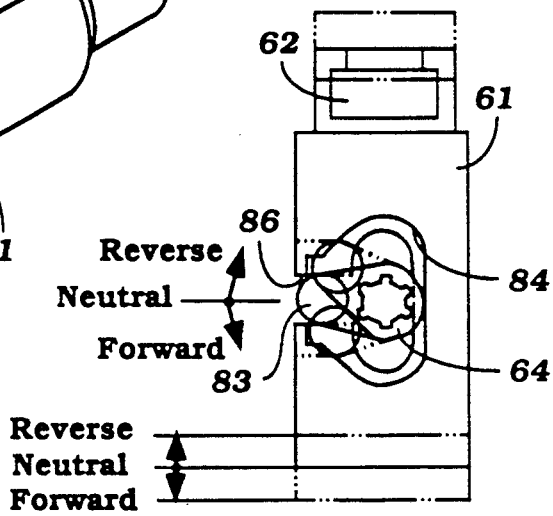
FIG. 8 is a top plan view of the shift actuating mechanism shown in this position.
Figure 9:
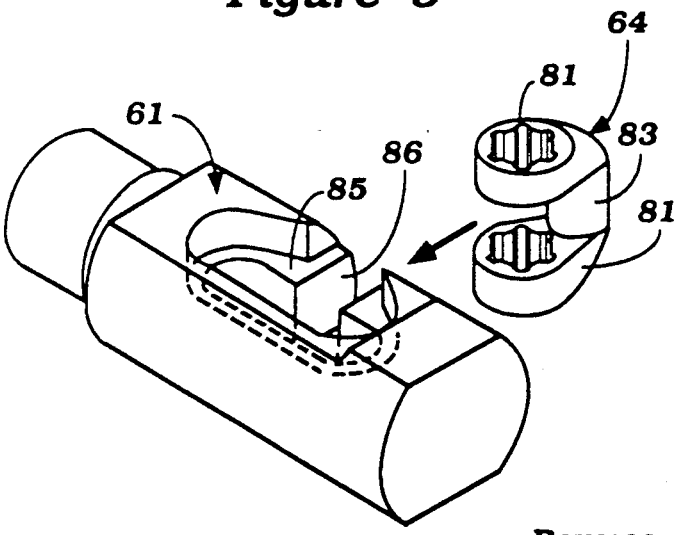
FIG. 9 is an exploded perspective view, in part similar to FIG. 7, showing the other operative position of the shift actuating mechanism.
Figure 10:
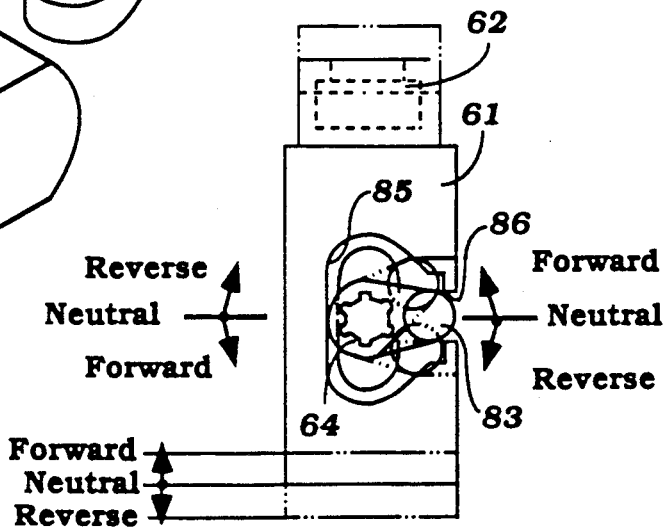
FIG. 10 is a top plan view, in part similar to FIG. 8, showing this other position.
Figure 11:
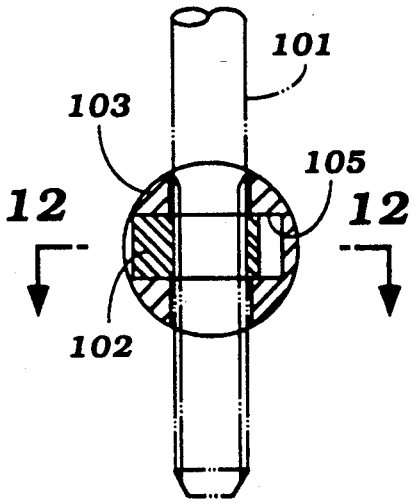
FIG. 11 is a partial cross-sectional view, in part similar to FIG. 6, and shows another embodiment of the invention.
Figure 12:
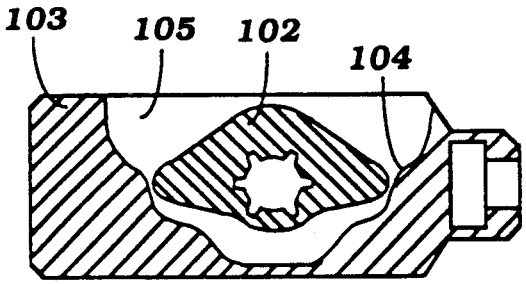
FIG. 12 is a cross-sectional view taken along the line 12—12 of FIG. 11.
Figure 13:
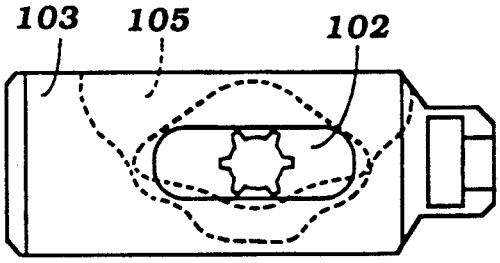
FIG. 13 is a top plan view of this embodiment shown in one operative position.
Figure 14:
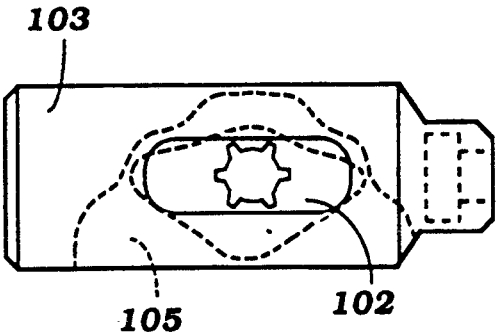
FIG. 14 is a top plan view of this embodiment shown in the other operative position.

How this is achieved will now be described by particular reference to FIGS. 4 through 10 as to this embodiment. It will be noted that the crank shaped cam member 64 is formed as a separate piece from the shift rod assembly 63 and has a pair of offset bearing portions 81 that have splined openings so as to receive a corresponding splined portion 82 of the lower end part 65 of the control rod 63. Hence, the portion 61 will rotate as a unit with the control rod 63 and thus forms a part of its assembly. Offset to one side of the portions 81, the cam or crank member 64 is provided with an eccentric cam portion 83. It will be noted that the splined connection between the cam member 61 and the control rod portion 65 permits the eccentric cam portion 83 to be disposed either on the left side of a plane containing the axis of rotation of the control rod 63 as shown in FIGS. 7 and 8 or on the right side of this plane as shown in FIGS. 9 and 10. The arrangement shown in FIGS. 7 and 8 is that employed with the motor 23 while that in FIGS. 9 and 10 is that associated with the motor 24, for reasons which will become apparent.

The plunger 61 has, in cross-section, a generally oval shape. There are provided upper and lower recesses 84 and 85 which are elongated and are generally symmetrical to the cam portions 81 so as to permit sliding movement of the plunger 61 but some cooperation with the portions 81 so as to maintain alignment. There is provided an eccentric slot 86 which extends to one side of the plunger 61 and which is adapted to receive the cam or crank portion 83 of the member 64. The tongue and groove portion 62 cooperates with a cylindical headed portion of the shift sleeve 58 and thus will be connected to this sleeve regardless of whether the plunger 61 is positioned in the orientation as shown in FIGS. 7 and 8 or in the orientation as shown in FIGS. 9 and 10. The only difference is that the groove 62 will face upwardly in the forward position and downwardly in the rearward position. The shape of the slots 84 and 85 and eccentric portion 86 is symmetrical about a horizontally extending plane which is perpendicular to the axis of rotation of the shift rod 63. As a result, a single crank or cam member 64 and plunger 61 may be utilized with either the outboard motor 23 or the outboard motor 24.

As may be seen in FIGS. 7 and 8, when the orientation is such that the crank member portion 83 is on the left side of the plane containing the axis of rotation of the shift rod 63, the plunger 61 is positioned in its upright position so that the cam follower slot 86 is also on the left side of this axis. As a result, when the shift rod 63 is rotated in a counterclockwise direction from the neutral position as shown in FIGS. 7 and 8, the plunger 61 will be forced forwardly so as to bring the dog clutching sleeve 49 into engagement with the bevel gear 38 and drive the propeller 31 in the forward direction. However, when the components are reversed, as shown in FIGS. 9 and 10, as is the case with the outboard motor 24, the corresponding rotation of the shift rod 63 will cause the plunger 61 to be shifted rearwardly so as to move the dog clutching sleeve 49 into engagement with the bevel gear 39 so as to rotate the propeller 35 in the opposite sense but nevertheless in the forward direction due to the opposite hand of the propeller 35 from the propeller 31.

Hence, it should be readily apparent that the described construction is effective in permitting reverse rotation of the propellers 31 and 35 while shifting the shift levers in the same direction.

FIGS. 11 through 14 show another embodiment of the invention wherein a different form of cam and cam follower arrangement is employed. Because this is the only difference between this embodiment and the embodiment of FIGS. 1 through 10, only this portion of the structure has been shown. In this embodiment, the shift rod is indicated generally by the reference numeral 101 and has a splined connection to a cam 102. The cam 102 is received within a plunger 103 that is supported for reciprocation in the manner as previously described. The plunger 103 is formed with a cam surface 104 that cooperates with the cam 102 and which forms a portion of a recess 105 that is configured so that rotation of the cam 102 will effect reciprocation of the plunger 103. The eccentricity and configuration of the cam 102 is such that it can be inverted or rotated through 180 degrees to achieve right to left operation while the plunger 103 is inverted between the position shown in FIG. 13 and the position shown in FIG. 14 to effect the reverse operation.

It should be readily apparent from the foregoing description that the described construction is highly effective in providing a simple way for insuring reverse rotation of two outboard drives only through simple repositioning of common parts. Although two embodiments of the invention have been illustrated and described, various changes and modifications may be made without departing from the spirit and scope of the invention, as defined by the appended claims.

What is claimed is:

1. A shift mechanism for a marine propulsion transmission comprising a housing defining a recess adapted to receive a shift plunger and supporting said shift plunger for reciprocation, said shift plunger being formed with a cam recess adapted to receive a cam, a cam supported for rotation relative to said housing about a fixed axis lying within a first plane and received within said cam recess of said shift plunger, said cam having an eccentric portion and being reversible between a first operative cam position and a second operative cam position, said plunger recess also including a portion for receiving said cam portion and being symmetrical about a second plane perpendicular to said first plane for reversal of said plunger in said recess between first and second operative plunger positions for reversing the direction of reciprocation of said plunger in response to rotation of said cam about said first axis in the same direction.

2. A shift mechanism as set forth in claim 1 wherein the cam has a tongue and groove connection to a shift member.

3. A shift mechanism as set forth in claim 2 wherein the tongue and groove connection permits operation of the shift member and rotation of the shift member regardless of the orientation of the plunger.

4. A shift mechanism as set forth in claim 1 wherein the cam has a keyed connection to a shift rod for rotation of said cam relative to said shift rod to either of the cam positions.

5. A shift mechanism as set forth in claim 1 in combination with a bevel gear transmission comprised of a driving bevel gear and a pair of counterrotating driven bevel gears operatively associated with a propeller shaft, a dog clutching element positioned between said driven bevel gears and axially movable into selected engageable positions with said driven bevel gears for driving said propeller shaft in selected forward and reverse directions.

6. A shift mechanism as set forth in claim 5 wherein the cam has a tongue and groove connection to a shift member.

7. A shift mechanism as set forth in claim 6 wherein the tongue and groove connection permits operation of the shift member and rotation of the shift member regardless of the orientation of the plunger.

8. A shift mechanism as set forth in claim 7 wherein the cam has a keyed connection to a shift rod for rotation of said cam relative to said shift rod to either of the cam positions.

* * * * *